US008134520B2

(12) United States Patent
Noro et al.

(10) Patent No.: US 8,134,520 B2
(45) Date of Patent: Mar. 13, 2012

(54) ANTENNA APPARATUS

(75) Inventors: Junichi Noro, Tokyo (JP); Kyuichi Sato, Tokyo (JP); Takao Kato, Tokyo (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 296 days.

(21) Appl. No.: 12/476,764

(22) Filed: Jun. 2, 2009

(65) Prior Publication Data

US 2009/0295678 A1 Dec. 3, 2009

(30) Foreign Application Priority Data

Jun. 3, 2008 (JP) ..... P2008-145385

(51) Int. Cl.
*H01Q 1/50* (2006.01)

(52) U.S. Cl. ..... 343/906

(58) Field of Classification Search ..... 343/906, 343/702, 884

See application file for complete search history.

(56) References Cited

U.S. PATENT DOCUMENTS

| | | | | |
|---|---|---|---|---|
| 7,317,946 | B2 * | 1/2008 | Twetan et al. | 607/60 |
| 7,405,706 | B2 * | 7/2008 | Ikeda et al. | 343/713 |
| 2006/0038727 | A1 * | 2/2006 | Ikeda et al. | 343/713 |
| 2008/0316108 | A1 * | 12/2008 | Chen et al. | 343/700 MS |
| 2010/0033391 | A1 * | 2/2010 | Mclean | 343/786 |
| 2011/0050514 | A1 * | 3/2011 | Schipper et al. | 343/702 |

FOREIGN PATENT DOCUMENTS

| | | |
|---|---|---|
| JP | 11 243309 | 9/1999 |
| JP | 2001 223511 | 8/2001 |
| JP | 2002-151927 | 5/2002 |
| JP | 2007-13273 | 1/2007 |
| WO | WO 01/61781 | 8/2001 |

* cited by examiner

*Primary Examiner* — Huedung Mancuso
(74) *Attorney, Agent, or Firm* — Whitham Curtis Christofferson & Cook, PC

(57) ABSTRACT

An antenna apparatus is disclosed. A circuit board has a first face, a second face opposite to the first face, and an edge formed with a notch connecting the first face and the second face. A circuit is arranged on the first face. An antenna element is configured to receive radio waves. A connecting member includes a first part coupled to the antenna element at a position opposing the second face and a second part fitted with the notch and elastically connected to the circuit.

6 Claims, 3 Drawing Sheets

ANTENNA APPARATUS

BACKGROUND

The present invention relates to an antenna apparatus. More specifically, the present invention is directed to a connection structure for causing a rod antenna mounted on a top cover to be connected with respect to a circuit board.

As is well known in this technical field, various sorts of antenna apparatuses are presently mounted on vehicles. For instance, antennas designed for receiving AM/FM radio waves are provided. Generally speaking, a rod antenna is used for such antennas.

An antenna apparatus equipped with the rod antenna is constructed with following structure. The rod antenna is mounted on a top cover. The top cover is combined with a base so as to form an antenna case. The antenna cover accommodates a circuit board mounting an amplifying circuit (booster circuit). The rod antenna is supported and fixed on the top cover by a supporting metal fitting (connector). The supporting metal fitting receives a reception signal received by the rod antenna.

In the antenna apparatus having above-described structure, the rod antenna is required to be electrically connected to the circuit board (namely, amplifying circuit). Various sorts of such connection structures are proposed.

Patent Document 1 discloses an antenna apparatus wherein a conductive member is mounted on an upper face of a circuit board. An amplifying circuit is arranged on a lower face of the circuit board. The conductive member is connected to a rod antenna so as to be electrically connected to the amplifying circuit. As will be later explained with reference to FIG. 1, in this case, a first end portion of a rod-side terminal (contact), a second end portion of which is mounted on a connector, and the second end portion of the rod-side terminal must be inserted into the conductive member in order to establish electric connection.

Patent Document 2 discloses a contact which connects an amplifying circuit with a rod antenna. This contact is formed from an elongated metal sheet so as to continuously include a flat portion, a contact portion and a mounting portion. The contact portion is adapted to come in contact with the rod antenna, and extends obliquely relative to the flat portion. The mounting portion is projected from the flat portion to an opposite side of the contact portion, and formed with claws. When the mounting portion is inserted into a hole formed on the circuit board, the claws engage with the edge of the hole to firmly retain the contact on the circuit board.

[Patent Document 1] Japanese Patent Publication No. 2007-013273 A

[Patent Document 2] Japanese Patent Publication No. 2002-151927 A

With reference to FIG. 1, there will be described a conventional antenna apparatus 10 having such a connection structure that is disclosed in Patent Document 1.

The antenna apparatus 10 has an antenna case and a rod antenna 20. The antenna case is constituted by a top cover 25 and a die casting base 60. The rod antenna 20 is mounted on the top cover 25. The rod antenna 20 is configured to receive radio waves of AM, FM, telephonic bands. A circuit board 15 mounting an amplifying circuit (not shown) is stored in the antenna case. The rod antenna 20 is arranged in such a manner that the rod antenna 20 is inclined from a vertical line. The rod antenna 20 is fixed and supported on the top cover 25 by a connector 30. Signals received by the rod antenna 20 are input to the connector 30.

A conductive member 80 is mounted on an upper face 15*a* of the circuit board 15. The conductive member 80 is connected to the rod antenna 20 in the following manner so as to be electrically connected to an amplifying circuit.

The antenna apparatus 10 comprises a rod-side terminal (contact) 40. A first end portion 40*a* of the rod-side terminal (contact) 40 is mounted on the connector 30, whereas a second end portion 40*b* of the rod-side terminal (contact) 40 is inserted into the conductive member 80 so as to be electrically connected to the conductive member 80.

A lower face of the die casting base 60 is covered by a base pad 70. The lower portion of the die casting base 60 is formed with a boss 65, in order to mount the antenna apparatus 10 on a roof panel of an automobile (not shown). Also, one terminal portion of an output cable (not shown) is connected to the circuit board 15, and the die casting base 60 is formed with a hole (not shown) in order to lead the output cable to exterior of the top cover 25.

Since the connection structure of such a conventional antenna apparatus 10 comprises the rod-side terminal (contact) 40 and the conductive member 80, a total number of the components is increased. As a result, the manufacturing cost is increased. Also, since the above-described connection structure of the antenna apparatus 10 is made of two components, an assembling work of the connection structure cannot be facilitated. Furthermore, the conductive member 80 is mounted on the upper face 15*a* of the circuit board 15. As a result, a space for mounting the conductive member 80 must be provided, so that the height of the antenna case can be hardly reduced.

On the other hand, the contact disclosed in the Patent Document 2 has such a complex structure. Also, since the circuit board must be formed with the through hole, the area of the circuit board is enlarged. As a result, the antenna apparatus becomes bulky.

SUMMARY

It is therefore one advantageous aspect of the present invention to provide an antenna apparatus capable of decreasing a total number of components thereof so as to reduce manufacturing cost of the antenna apparatus.

It is therefore another advantageous aspect of the present invention to provide an antenna apparatus capable of facilitating an assembling work of the antenna apparatus.

It is therefore another advantageous aspect of the present invention to provide an antenna apparatus capable of reducing a height of the antenna apparatus.

It is therefore another advantageous aspect of the present invention to provide an antenna apparatus having a connection structure whose structure is simple.

It is therefore another advantageous aspect of the present invention to provide a compact antenna apparatus in which an area of a circuit board need not be widened.

According to one aspect of the invention, there is provided an antenna apparatus comprising:

a circuit board having a first face, a second face opposite to the first face, and an edge formed with a notch connecting the first face and the second face;

a circuit arranged on the first face;

an antenna element configured to receive radio waves; and a connecting member comprising a first part coupled to the antenna element at a position opposing the second face and a second part fitted with the notch and electrically connected to the circuit.

The antenna apparatus may be configured such that: the notch is plated with a conductive material.

The antenna apparatus may be configured such that: the conductive material is gold.

The antenna apparatus may be configured such that: at least the second part of the connecting member has elasticity.

The antenna apparatus may be configured such that: the antenna element is configured to receive AM broadcast radio waves, FM broadcast radio waves, and a telephone band radio waves.

The antenna apparatus may further comprise screw members coupling the antenna element and the first part of the connecting member.

The antenna apparatus may be configured such that: the connecting member includes a part opposing the second face of the circuit board and extending parallel to the second face of the circuit board.

With the above configurations, a total number of components of the antenna apparatus can be decreased so as to reduce manufacturing cost thereof; the assembling characteristic thereof can be improved; and the height of the antenna apparatus can be lowered.

DETAILED DESCRIPTION OF EXEMPLIFIED EMBODIMENTS

Exemplified embodiments of the invention are described below in detail with reference to the accompanying drawings.

Figure 2:
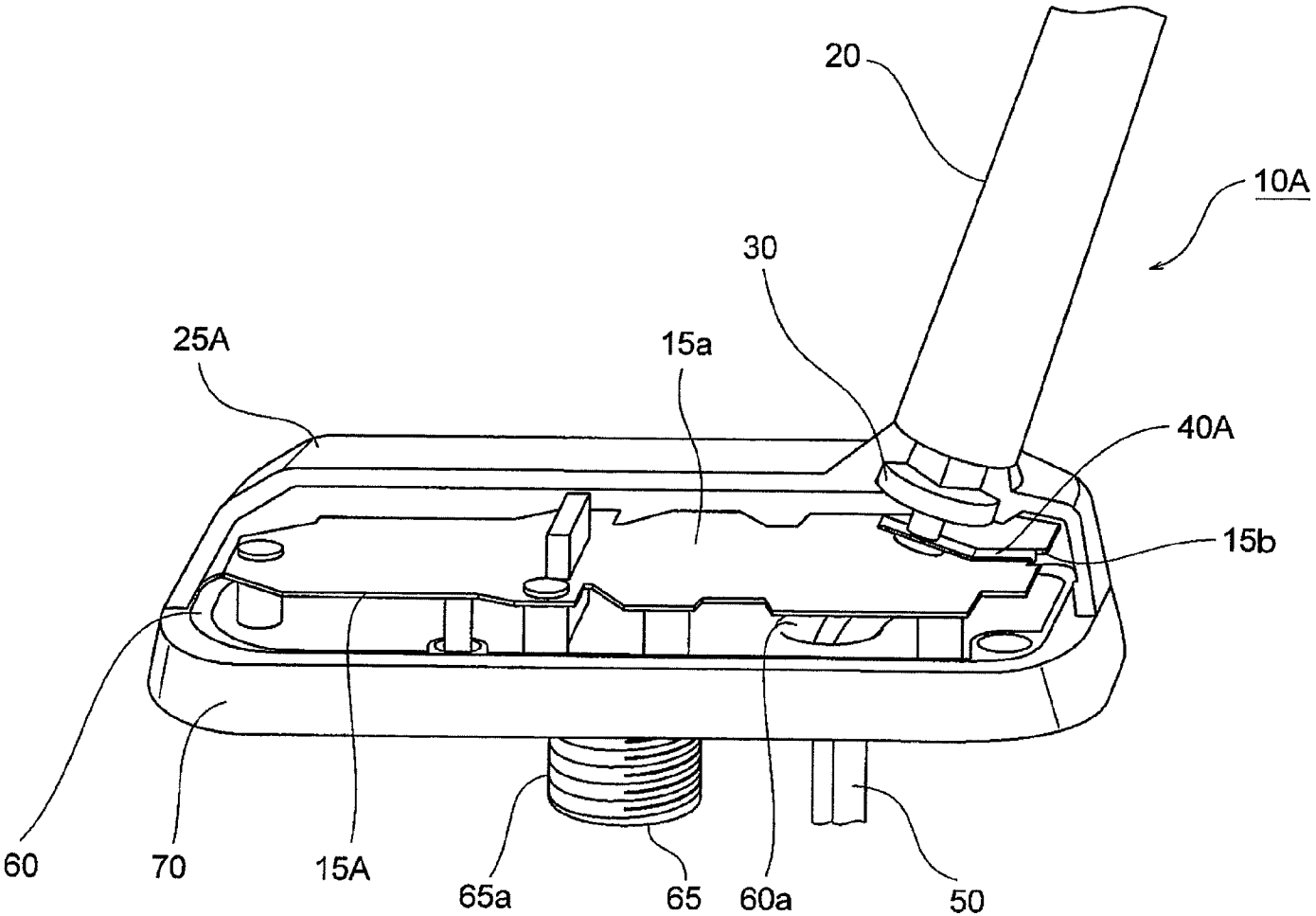
FIG. 2 is a see-through perspective view showing an internal structure of the antenna apparatus according to one embodiment of the present invention.
Figure 3:
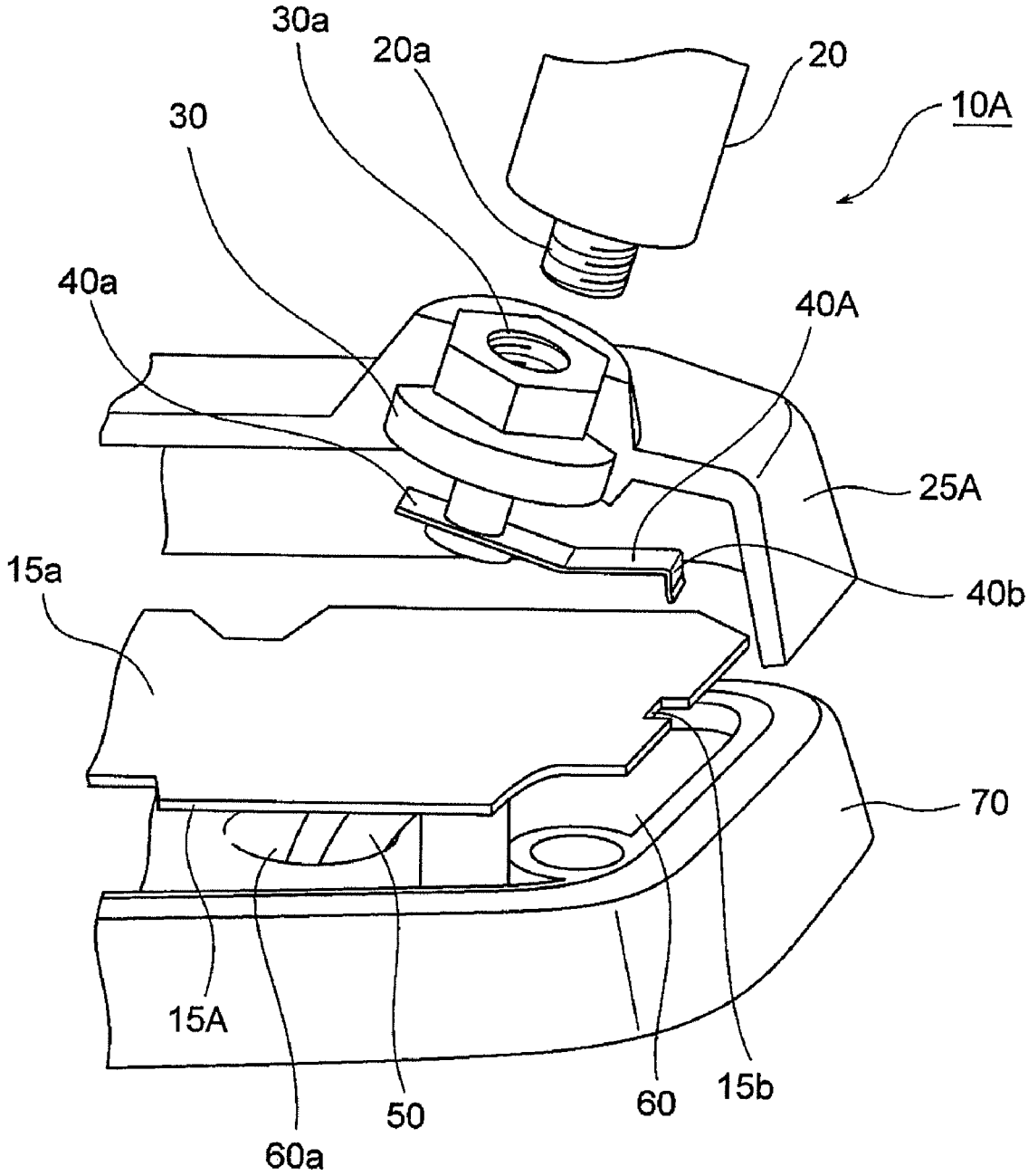
FIG. 3 is an enlarged see-through perspective view showing a part of the antenna apparatus shown in FIG. 2.

With reference to FIGS. 2 and 3, there will be described an antenna apparatus 10A according to one embodiment of the present invention.

Figure 1:
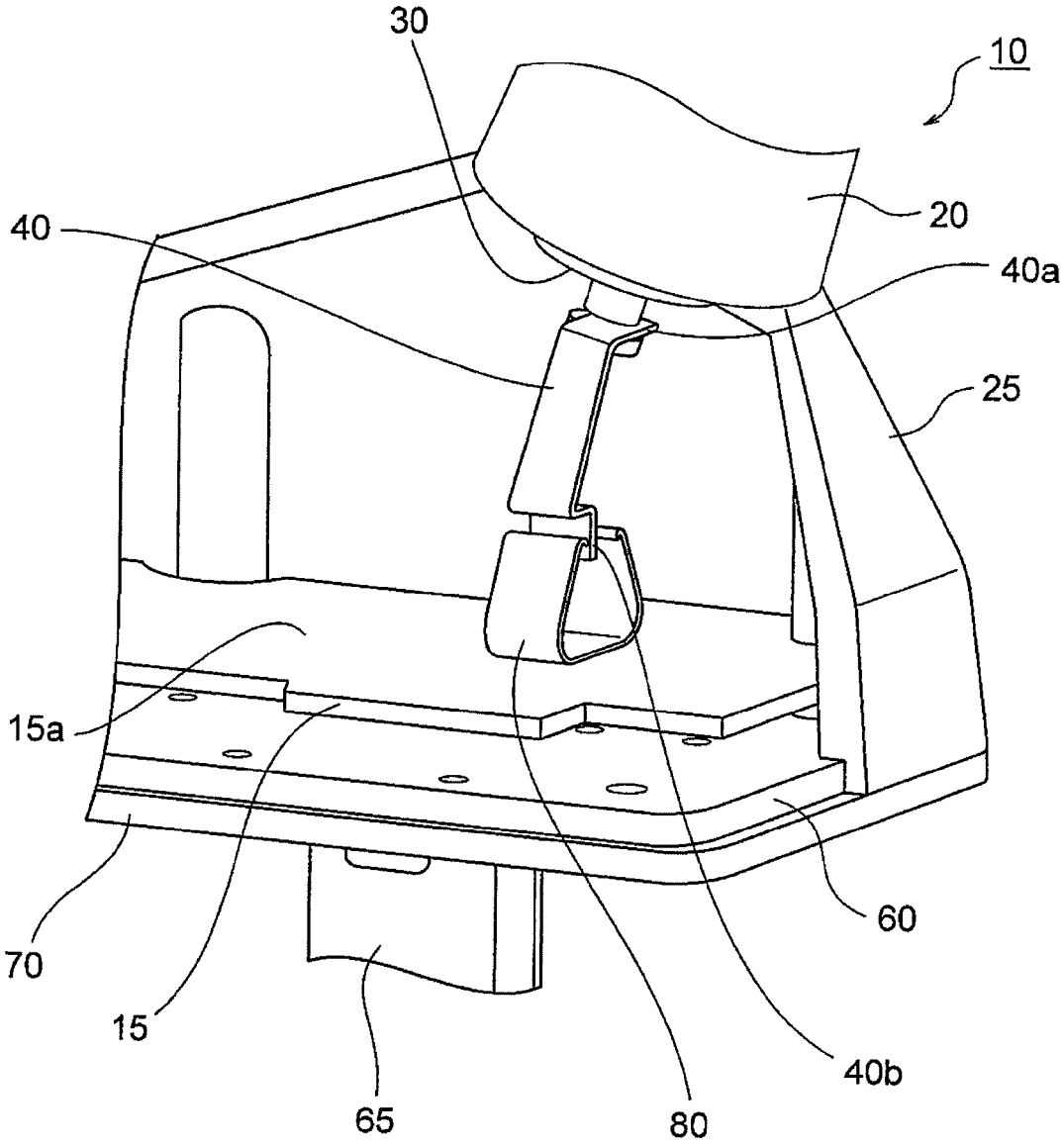
FIG. 1 is a see-through perspective view showing an internal structure of the conventional antenna apparatus.

The antenna apparatus 10A has a similar structure to that of the antenna apparatus 10 shown in FIG. 1 except for the following items. That is, while the above-explained conductive member 80 is eliminated, a rod-side terminal (contact), a circuit board, and a top case are changed, which will be discussed later. As a consequence, such reference numerals as "40A", "15A", and "25A" are applied to the rod-side terminal (contact), the circuit board, and the top case, respectively. Components similar to those in the antenna apparatus 10 will be denoted by the same reference numerals and repetitive explanations for those will be omitted.

The antenna apparatus 10A is not equipped with the above-described conductive member 80, which is different from the conventional antenna apparatus 10. As a consequence, a height of the top case 25A is lower than the height of the top case 25 of the conventional antenna apparatus 10. As a result, the space for mounting the conductive member 80 on the upper face 15*a* of the circuit board 15 is no longer required in this antenna apparatus 10A.

As shown in FIG. 3, the rod antenna 20 has a male screw portion 20*a* at a base portion of this rod antenna 20, while a male screw is formed in an outer circumferential face of the rod antenna 20. On the other hand, the connector 30 has a female screw portion 30*a* with which the male screw is meshed, while a female screw is formed in an inner circumferential face of the connector 30. As a consequence, the male screw portion 20*a* of the rod antenna 20 is meshed with the female screw portion 30*a* of the connector 30, so that the rod antenna 20 can be mounted and fixed on the top cover 25A.

A notch 15*b* is formed in an edge of the circuit board 15A. An inner wall of the notch 15*b* is plated with gold in order to improve a contact characteristic. The rod-side terminal (contact) 40A is made of a metal having elasticity. A first end portion 40*a* of the rod-side terminal (contact) 40A is mounted on the connector 30. A second end portion 40*b* of the rod-side terminal (contact) 40A is brought into elastic contact with the notch 15*b*. The first end portion 40*a* is fixed to an end portion of the connector 30 by screwing, caulking, or soldering.

As a result, signals can be transmitted from connector 30 to the circuit board 15A. Also, while the rod-side terminal (contact) 40A is made of the metal having elasticity, the top cover 25A is fixed on the die casting base 60 by screwing. As a result, the second end portion 40*b* of the rod-side terminal (contact) 40A is brought into elastic contact with the notch 15*b* formed in the circuit board 15A, so that constant pressure is always applied to the notch 15*b*. Also, the first end portion 40*a* of the rod-side terminal (contact) 40A is fixed on the connector 30 in such a manner that the first end portion 40*a* is inclined with respect to the face of the circuit board 15A, an intermediate portion of the rod-side terminal (contact) 40A is bent in such a manner that an intermediate portion is made substantially parallel to the circuit board 15A. The second end portion 40*b* thereof is bent in a direction substantially perpendicular to the circuit board 15A. As a result, the second end portion 40*b* can be firmly engaged with the notch 15*b*, so that contact stability can be improved. The second end portion 40*b* may be fitted with the notch 15*b*, so that a position of the second end portion 40*b* is regulated by the notch 15*b*. As a result, the contact stability can be more improved.

A male screw 65*a* is formed in an outer circumferential face of the boss 65. Also, one terminal portion of an output cable 50 is connected to the circuit board 15A, and a hole 60*a* for leading the output cable 50 out of the antenna apparatus 10A is formed in the die casting base 60.

As has been described the above, according to the antenna apparatus 10A of this embodiment, only the circuit board 15A mounting the amplifying circuit is involved in the joint working without using an additional conductive member such as the circuit-side terminal 80 shown in FIG. 1. As a result, the total number of components can be reduced while facilitating the assembling work of the antenna apparatus.

Although only some exemplary embodiments of the invention have been described in detail above, those skilled in the art will readily appreciated that many modifications are possible in the exemplary embodiments without materially departing from the novel teachings and advantages of the invention. Accordingly, all such modifications are intended to be included within the scope of the invention.

The notch 15*b* may be plated with a conductive material other than gold.

The inner wall of the notch 15*b* may be not plated with a conductive material, as long as the second end portion 40*b* is electrically connected to the amplifying circuit mounted on the circuit board 15A. For example, the second end portion 40*b* may be formed as a hook-shape so that an end tip of the hook-shape contacts the lower face of the circuit board 15A.

The rod-side terminal 40A may have a mechanism causing the second end portion 40*b* to have elasticity. Furthermore, a part of the rod-side terminal 40A may not have elasticity as long as at least the second end portion 40*b* has elasticity.

The disclosure of Japanese Patent Application No. 2008-145385 filed Jun. 3, 2008 including specification, drawings and claims is incorporated herein by reference in it is entirety.

What is claimed is:

1. An antenna apparatus comprising:

a circuit board on which a circuit is arranged, and having an edge formed with a notch which is plated with a conductive material electrically connected to the circuit;

an antenna element configured to receive radio waves; and a connecting member comprising a first part coupled to the antenna element at a position opposing the circuit board and a second part fitted with the notch and electrically connected to the circuit through the conductive material.

2. The antenna apparatus set forth in claim 1, wherein the conductive material is gold.

3. The antenna apparatus set forth in claim 1, wherein at least the second part of the connecting member has elasticity.

4. The antenna apparatus set forth in claim 1, wherein the antenna element is configured to receive AM broadcast radio waves, FM broadcast radio waves, and a telephone band radio waves.

5. The antenna apparatus set forth in claim 1, further comprising screw members coupling the antenna element and the first part of the connecting member.

6. The antenna apparatus set forth in claim 1, wherein the connecting member includes a part opposing a face of the circuit board and extending parallel to the face of the circuit board.

* * * * *